US006270377B1

(12) United States Patent
Miyazaki et al.

(10) Patent No.: US 6,270,377 B1
(45) Date of Patent: Aug. 7, 2001

(54) SHIELDING CONNECTOR

(75) Inventors: Sho Miyazaki; Tetsuo Ichioka, both of Nagoya (JP)

(73) Assignees: Harness System Technologies Research, Ltd., Aichi; Sumitomo Wiring Systems, Ltd., Mie; Sumitomo Electric Industries, Ltd., Osaka, all of (JP)

( * ) Notice: Subject to any disclaimer, the term of this patent is extended or adjusted under 35 U.S.C. 154(b) by 0 days.

(21) Appl. No.: 09/352,334

(22) Filed: Jul. 13, 1999

(30) Foreign Application Priority Data

Jul. 16, 1998 (JP) ..... 10-202300
Sep. 16, 1998 (JP) ..... 10-261815

(51) Int. Cl.[7] ..... H01R 9/03
(52) U.S. Cl. ..... 439/610; 439/98
(58) Field of Search ..... 439/610, 98, 99, 439/275, 607, 608, 585; 174/74 R, 75 C

(56) References Cited

U.S. PATENT DOCUMENTS

| | | | | |
|---|---|---|---|---|
| 4,781,623 | * | 11/1988 | Philippson et al. | 439/610 |
| 5,145,409 | * | 9/1992 | Sato et al. | 439/585 |
| 5,429,529 | | 7/1995 | Hashizawa et al. | 439/610 |
| 5,498,176 | | 3/1996 | Shigemi et al. | 439/585 |
| 5,965,847 | * | 10/1999 | Tanaka et al. | 439/610 |
| 6,039,605 | * | 2/2000 | Tanaka | 439/610 |

FOREIGN PATENT DOCUMENTS

| | | |
|---|---|---|
| 22 61 973 | 6/1974 | (DE) . |
| 0 694 989 A2 | 1/1996 | (EP) . |
| 0 841 718 | 5/1998 | (EP) . |
| 63-202080 U | 12/1988 | (JP) . |
| 6-260246 | 9/1994 | (JP) . |
| 8-45575 | 2/1996 | (JP) . |
| B2 2-937225 | 6/1999 | (JP) . |

* cited by examiner

*Primary Examiner*—Gary F. Paumen
*Assistant Examiner*—Alexander Gilman
(74) *Attorney, Agent, or Firm*—Oliff & Berridge, PLC

(57) ABSTRACT

In the shielding connector, a plurality of angular-shaped elastic tongue pieces 65 are provided on and projected inwardly from the upper and lower surfaces of the rear end portion of a prismatic-shaped shielding shell 60 which is so disposed as to cover a shielding wire 30 to be inserted into a housing 1; and, when the shell connecting portion 52 of a shell connecting terminal 50 is held by and between the upper and lower elastic tongue pieces 65, then they can be connected together electrically. To the shielding wire 30, there are sequentially connected the shell connecting terminal 50 and flat type male terminal 40. Since the shell connecting portion 52 of the shell connecting terminal 50 is formed in an annular shape, the shell connecting portion 52 has no insertion direction limit with respect to the elastic tongue pieces 65. Thanks to this, when connecting the flat type male terminal 40 to the shielding wire 30, there is eliminated the need to pay special attention to the connecting position of the shell connecting terminal 50 in the peripheral direction thereof. This makes it possible to simplify the terminal connecting operation.

6 Claims, 14 Drawing Sheets

SHIELDING CONNECTOR

BACKGROUND OF THE INVENTION

1. Field of the Invention

The present invention relates to a shielding connector which is improved in the terminal treatment of a shielding wire thereof.

2. Description of the Related Art

Conventionally, as a shielding connector, there is known a shielding connector which is disclosed in Japanese Patent Publication No. 6-260246 of Heisei. The thus disclosed shielding connector, as shown in FIG. 18, includes a cylindrical-shaped shielding shell c in such a manner as to cover a terminal storage chamber b within a housing a. In the terminal storage chamber b, there can be stored a flat type terminal g which is pressure contacted with a core wire e of a shielding wire d; and, a shell connecting portion i formed in a shell connecting terminal h connected to a braided wire f of the shielding wire d is contacted with the shielding shell c, whereby the core wire e can be shielded both inside and outside the housing a.

In the shell connecting portion i of the shell connecting terminal h, as shown in FIG. 19, there are disposed a plurality of elastic contact pieces j; and, the open end portions k of the elastic contact pieces j are so formed as to spread wide, so that the elastic contact pieces j can be elastically deformed.

However, because the shell connecting portion i is limited in size, even if the contact pressure is not sufficient, the size of the elastic contact piece j, which is disposed in the shell connecting portion i, cannot be increased over its size limitation, that is, the elastic force of the elastic contact piece J cannot be increased up to a sufficient level.

Also, before the shielding wire d is connected to the shielding connector, the transportation or the like of the shielding wire d is executed in its wound condition. However, there is a fear that, when winding the shielding wire d, the surface of the shielding wire d can be damaged by the open end portions k which are projected externally of the shell connecting portion h.

Further, depending on the shape of the housing a, the shielding shell c may be formed in a prismatic shape. In this case, in order to keep good contact with the prismatic-shaped shielding shelter c, the shell connecting portion i must also be formed in an angular shape.

However, the flat type terminal g is limited in the insertion direction with respect to the terminal storage chamber b, that is, the flat type terminal g has an insertion direction limit with respect to the terminal storage chamber b, and also the shell connecting portion i of the shell connecting terminal h has an insertion direction limit with respect to the prismatic-shaped shielding shell c. Therefore, when connecting the two terminals g and h to the shielding wire d, the connection positions of the two terminals g and h must be matched to each other with accuracy, in particular, after one terminal is connected to the shielding wire d, the other terminal must be connected to the shielding wire d in such a manner that the connection position of the other terminal must be matched accurately to the connection position of the previously connected terminal, namely, one terminal in the peripheral direction thereof. This makes it troublesome to connect the other terminal that is to be mounted later, resulting in the poor efficiency of the terminal connection operation.

Further, conventionally, as a structure for connecting the braided wire of a shielding wire to the shielding shell of a shielding connector, there is known a structure for caulking a connecting terminal to the end portion of the shielding wire. This type of structure is disclosed in Japanese Patent Publication No. 8-45575 of Heisei; and, in particular, as shown in FIG. 20, a shielding wire 101 is structured such that the periphery of a core wire 102 is covered by an insulating coating 103, the outer periphery of the insulating coating 103 is covered by a braided wire 104 formed by braiding together metal fine wires, and the outer periphery of the braided wire 104 is further covered by an outer coating 105. In the end portion of the shielding wire 101, the outer surface thereof is peeled off starting from the leading end thereof in such a manner that the core wire 102, insulating coating 103, braided wire 104 and outer coating 105 are sequentially exposed in this order; in particular, a receiving tube portion 106 is inserted into between and held by the insulating coating 103 and braided wire 104, and a connecting terminal 107 is caulked from the outer periphery of the braided portion 104 covering the outer periphery of the receiving tube portion 106.

The connecting terminal 107 is structured such that the inner peripheral surface 108 thereof is contacted with the braided wire 104, while the outer peripheral surface 109 thereof is fitted and contacted with the inner periphery of a shielding shell disposed within a connector housing (not shown). Due to this, the braided wire 104 and shielding shell can be connected in conduction to each other through the connecting terminal 107.

By the way, to establish an ideal contact condition between the connecting terminal 107 and braided wire 104, the inner peripheral surface 108 of the connecting terminal 107 may be closely contacted with the braided wire 104. Therefore, it can be imagined that a caulking force used to caulk the connecting terminal 107 is increased to a sufficient degree to thereby caulk the connecting terminal 107 while crushing the same. In this case, the outside diameter of the connecting terminal 107 is caused to vary in a decreasing manner by caulking. However, because the then varying amount of the outside diameter of the connecting terminal 107 cannot be set constant, there is a possibility that the contact state between the outer peripheral surface 109 of the connecting terminal 107 and the inner periphery of the shielding shell can be unstable.

On the other hand, in order to set up an ideal contact state between the shielding shell and connecting terminal 107, if the connecting terminal 107 is caulked such that the outside diameter of the connecting terminal 107 can be constant according to the inside diameter of the shielding shell, then it is difficult to caulk the connecting terminal 107 with a sufficient caulking force. Due to this, there is a possibility that the contact state between the braided wire 104 and the inner peripheral surface 108 of the connecting terminal 107 can be unstable. That is, in the above-cited conventional structure, the above-mentioned two kinds of contact states cannot be made ideal at the same time.

SUMMARY OF THE INVENTION

The present invention aims at eliminating the above-mentioned drawbacks found in the conventional shielding connector. Accordingly, it is an object of the invention to provide a shielding connector capable of simplifying an operation to connect a shell connecting terminal or a flat type terminal to a shielding wire which is to be connected to a prismatic-shaped shielding shell, and to provide a structure which is capable of establishing ideal contact states between the connecting terminal and braided wire as well as between the connecting terminal and shielding shell.

In attaining the above object, according to a first aspect of the invention, there is provided a shielding connector of a type structured such that, a shielding shell is disposed within a housing, a shielding wire includes a core wire connected to a terminal metal member and a braided wire connected to a shell connecting terminal, and a shell connecting portion formed in the shell connecting terminal is connected to the shield shell, wherein the shell connecting portion is formed in an annular shape and, on the inner periphery of the shielding shell, there is disposed an elastic tongue piece which can be contacted with the shell connecting portion.

In the conventional structure where the elastic contact piece is disposed on the shell connecting portion side, due to the size restriction of the shell connecting portion, there is a great limit to the size of the elastic contact piece. On the other hand, according to the invention, since the elastic tongue piece is disposed on the shielding shell side, the elastic tongue piece can be set relatively large, and the elastic tongue piece is allowed to have a large elastic force, so that the elastic tongue piece is able to hold the shell connecting portion more stably.

Also, in the conventional structure, the elastic contact piece disposed on the shell connecting portion side is structured such that the open end portion thereof is projected outwardly. However, according to the invention, there is no need to provide an elastic contact portion in the shell connecting portion and thus there is not formed such open end portion as in the conventional structure. Thanks to this, before the shielding wire is connected to the shielding connector, even when the shielding wire is wound for the purpose of transportation or the like, the surface of the shielding wire is made difficult to be damaged.

According to a second aspect of the present invention, the terminal metal member has an insertion direction limit with respect to a terminal insertion chamber formed in the housing, and the shielding shell is formed in a prismatic shape.

When the shielding shell is formed in a prismatic shape, the shell connecting terminal, differently from the square shape as in the conventional structure, can be formed in an annular shape, which can eliminate the insertion direction limit of the shell connecting portion with respect to the prismatic-shaped shielding shell. Thanks to this, when the terminal metal member (that is, flat type male terminal) and shell connecting terminal having an insertion direction limit with respect to the terminal storage chamber of the housing are respectively connected to the shielding wire, regardless of the connecting position of the previously connected terminal in the peripheral direction thereof, the remaining terminal can be connected simply, thereby being able to carry out the two terminal connecting operation in a simplified manner.

According to a third aspect of the present invention, in the invention as set forth in the second aspect, the shell connecting portion is formed in an annular shape with ends by caulking a U-shaped metal plate.

After the shielding wire with the braided wire exposed is placed on the bottom portion of the U-shaped shell connecting portion, if the shell connecting portion is caulked by a jig or the like, then the shell connecting portion can be connected to the braided wire. That is, the connecting operation of the shell connecting portion can be executed simply.

According to a fourth aspect of the present invention, there is, in the invention as set forth in any one of the first aspect to the third aspect, on the mutually opposing inner surfaces of the prismatic-shaped shielding shell, there are disposed a pair of elastic tongue pieces of the above-mentioned type.

Since the pair of elastic tongue pieces are respectively able to hold the shell connecting portion elastically from the mutually opposing surfaces thereof within the prismatic-shaped shielding shell, the contact pressure of the elastic tongue pieces with respect to the shell connecting portion can be enhanced further.

According to a fifth aspect of the present invention, there is provided a structure for treating the end portion of a shielding wire, in which a connecting terminal capable of connecting a shielding shell disposed within a housing and a braided wire included in a shielding wire to each other in a conductive state is caulked to the end portion of the shielding wire, characterized in that the connecting terminal comprises a shell contact portion to be contacted with the shielding shell and a braided wire contact portion to be contacted with the braided wire, and the shell contact portion and braided wire contact portion are connected to each other through a connecting portion which is interposed between the two contact portions.

The connecting terminal to be mounted on the end portion of the shielding wire is divided into two portions, the thus divided two portions are respectively used as the braided wire contact portion to be contacted with the braided wire and as the shielding shell contact portion to be contacted with the shielding shell within the housing, and the braided wire contact portion and shielding shell contact portion are connected together by the connecting portion interposed therebetween. Thanks to this, the braided wire contact portion can be caulked with a sufficient caulking force to thereby be able to establish an ideal contact state between the braided wire and itself; and, the shell contact portion can be caulked to the shielding wire while the outside diameter thereof is matched to the inside diameter of the shielding shell, thereby being able to realize an ideal contact state between the shielding shell and itself. That is, since a single connecting terminal is divided into a contact portion for the braided wire and a contact portion for the shielding shell and thus the single connecting terminal can be caulked at the different positions of the shielding wire in the axial direction thereof, not only the contact state between the connecting terminal and braided wire but also the contact state between the connecting terminal and shielding shell can be made ideal.

According to a sixth aspect of the present invention, in the invention as set forth the fifth aspect, between the braided wire contact portion and said shell contact portion, there is formed a stepped portion, and also one of the braided wire contact portion and shell contact portion is caulked to one of the outer coating removed and unremoved sides of the end portion of the shielding wire, while the other of the braided wire contact portion and shell contact portion is caulked to the other of the outer coating removed and unremoved sides.

In the end portion of the shielding wire, between the portion with the outer coating removed therefrom and the portion with the outer coating left unpeeled, there is formed the stepped portion equivalent to the thickness of the outer coating and, between the braided wire contact portion and shell contact portion of the connecting terminal, there is disposed the connecting portion which is so inclined that there can be formed the stepped portion having the same width as the former stepped portion. When caulking the connecting terminal to the end portion of the shielding wire, the braided wire contact portion and shell contact portion thereof may be positioned astride the outer coating removed side of the shielding wire and the outer coating unremoved side thereof, and one of the contact portions may be caulked to one of the outer coating removed and unremoved sides of the shielding wire, while the other contact portion may be caulked to the other side. Thanks to this, even if there is applied to the shielding wire the force to push in the shielding wire from the outer coating unremoved side thereof, the connecting portion of the connecting terminal is caught by the stepped portion formed in the shielding wire, thereby being able to prevent the connecting terminal from being shifted or removed in the axial direction thereof.

According to a seventh aspect of the present invention, in the invention as set forth in the fifth aspect, the braided wire contact portion and shell contact portion are respectively caulked to either of the outer coating removed side or the outer coating unremoved side of the end portion of the shielding wire.

When caulking the connecting terminal to the end portion of the shielding wire, the braided wire contact portion and shell contact portion thereof are caulked in such a manner that they cluster around one of the outer coating removed side and outer coating unremoved side of the shielding wire, thereby eliminating the need to dispose the connecting portion of the connecting terminal in the inclined attitude. This makes it possible to reduce the manufacturing cost of the connecting terminal.

The present disclosure relates to the subject matter contained in Japanese patent application Nos. Hei. 10-202300 (filed on Jul. 16, 1998) and Hei. 10-261815 (filed on Sep. 16, 1998), which are expressly incorporated herein by reference in its entirely.

DETAILED DESCRIPTION OF THE PREFERRED EMBODIMENTS

[First Embodiment]

Now, description will be given below of an embodiment of a shielding connector according to the invention with reference to FIGS. 1 to 7. In the present embodiment, a shielding connector according to the invention is applied to a male-side shielding connector.

Figure 1:
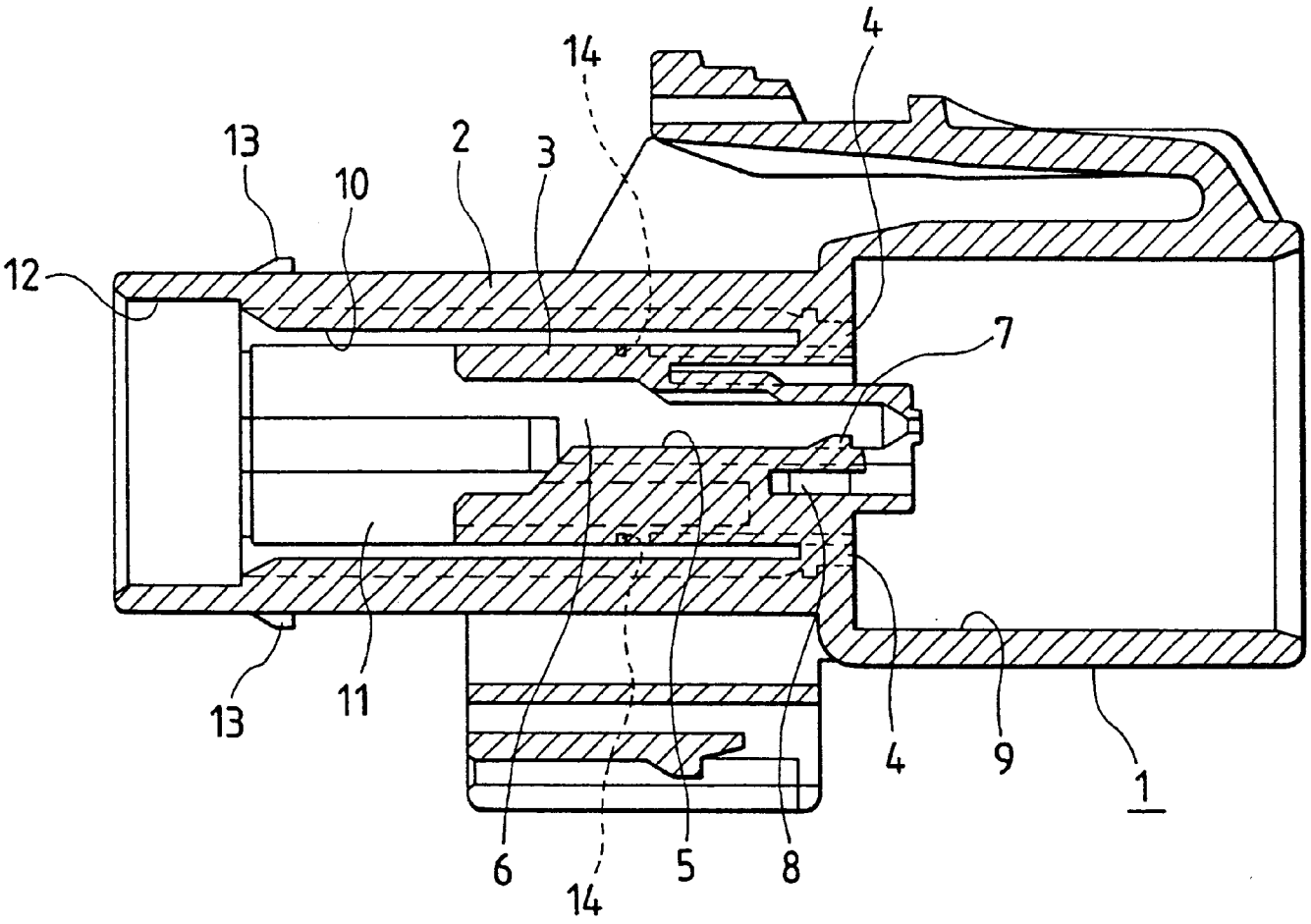
FIG. 1 is a section view of a shielding connector according to an embodiment of the invention.
Figure 2:
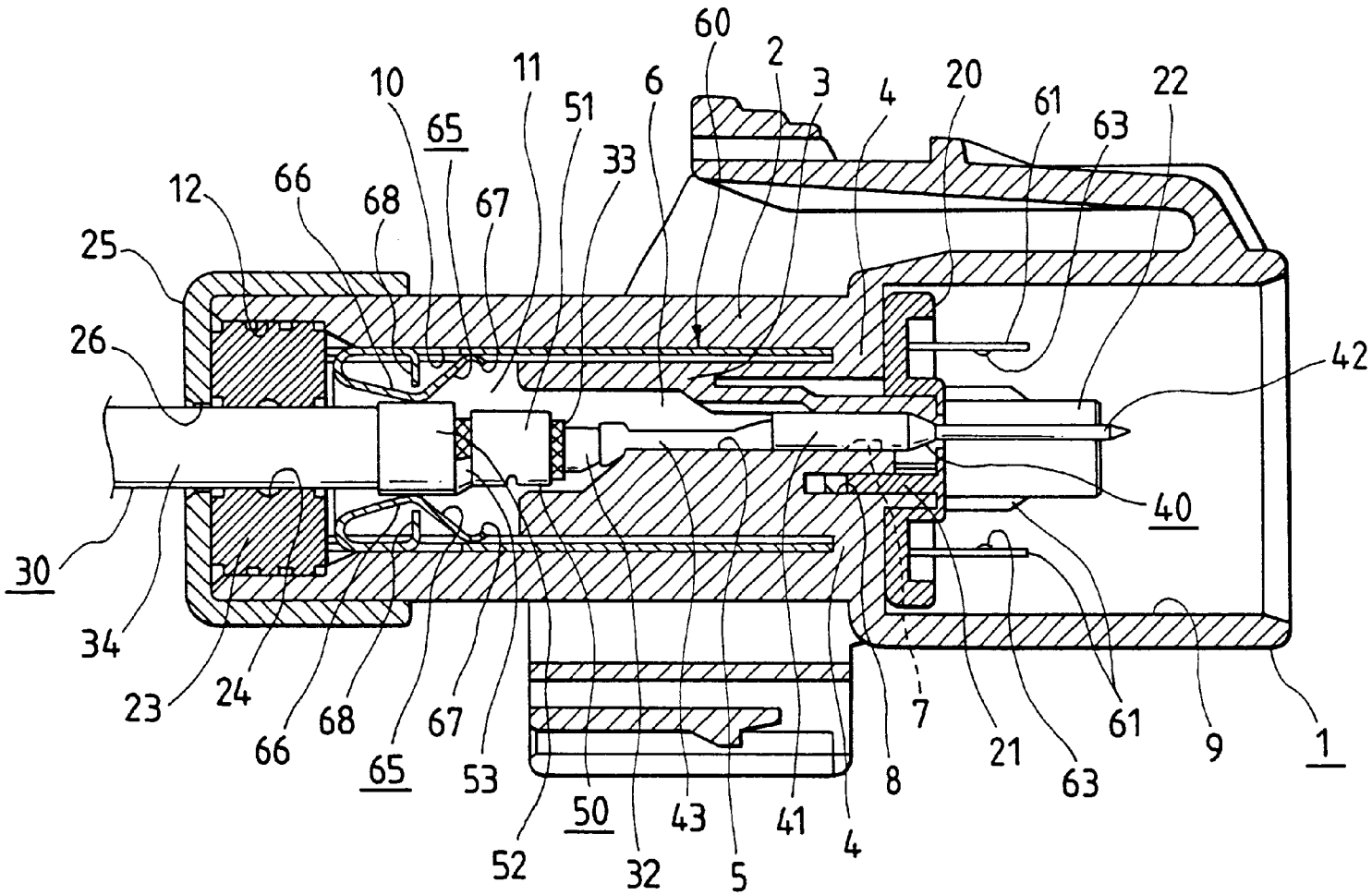
FIG. 2 is a section view of the shielding connector after it is assembled.

The present shielding connector, as shown in FIGS. 1 and 2, includes a prismatic-shaped shielding shell 60 within a male-side connector housing 1 (which is hereinafter referred to as a housing 1 simply) that is formed in a prismatic shape.

The housing 1 is formed as a double tube structure in which an outer tube portion 2 and an inner tube portion 3 located inside the outer tube portion 2 are both formed of synthetic resin as a united body. The inner tube portion 3 is situated substantially in the central portion of the housing 1 in the longitudinal (left and right) direction thereof and includes a support portion 4 formed in the front end portion thereof, while the support portion 4 is connected to the outer tube portion 2. Between the outer and inner tube portions 2 and 3, there is mounted a prismatic-shaped shielding shell 60 (the details of which will be described later) and, in the inside of the inner tube portion 3, there is disposed a terminal storage chamber 5 which is capable of storing a flat type male terminal 40 therein. The terminal storage chamber 5 is divided in the lateral direction thereof into three chambers with their respective side walls 6 therebetween, each division chamber is formed such that a section thereof has a substantially rectangular shape, and three lances 7 are respectively provided on and projected from the lower surfaces of the front end sides of their associated division chambers. Downwardly of the respective lances 7, there are formed flexure spaces 8 respectively; that is, the respective lances 7 can be elastically deformed into their respective downwardly located flexure spaces 8 by the flat type male terminal 40 which is to be inserted into the terminal storage chamber 5.

In front of (on the right side) the inner tube portion 3, there is disposed a fitting recessed portion 9 into which a female-side housing (not shown) can be fitted, and a front retainer 20 can be mounted from ahead the fitting recessed portion 9. On the rear surface of the front retainer 20, there is disposed a flexure restrict piece 21; and, the flexure restrict piece 21 can be inserted into the flexure space 8 to thereby restrict the flexing deformation of the lance 7. On the other hand, on the front surface of the front retainer 20, there is projectingly provided a rib 22 which is used to help the fit or engagement of the front retainer 20 with the female-side housing.

Figure 4:
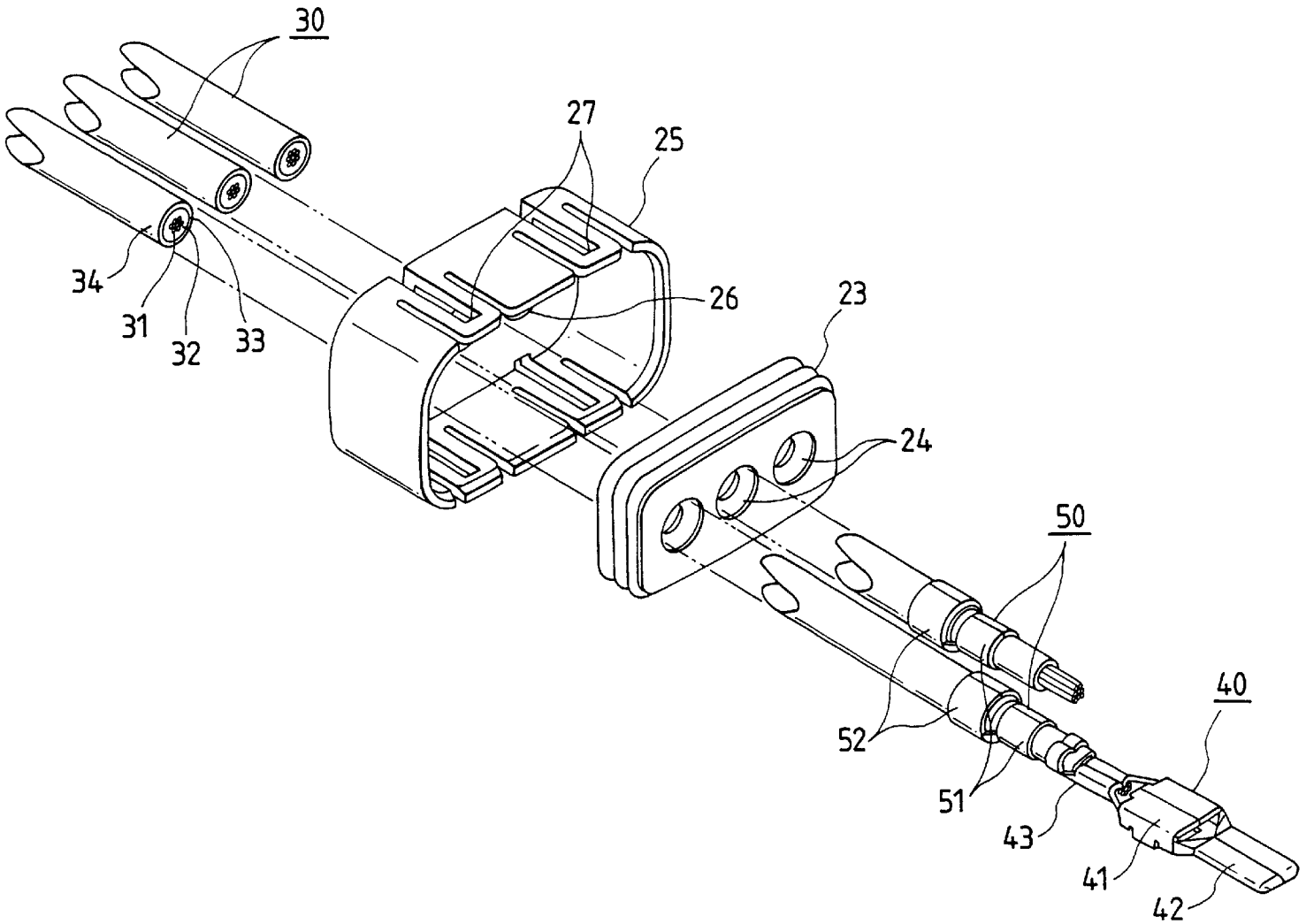
FIG. 4 is an exploded perspective view of a shielding wire, a back retainer, and a package rubber plug, showing a state in which the shielding wire is inserted through the back retainer and package rubber plug.

In the rear (on the left side) of the inner tube portion 3, there is formed a shell connecting terminal storage chamber 10 in communication with the terminal storage chamber 5 and, similarly to the terminal storage chamber 5, the shell connecting terminal storage chamber 10 is divided into three chambers by partition plates 11 which are respectively provided on and projected backwardly from the inner tube portion 3. In the rear of the shell connecting terminal storage chamber 10, there is formed an opening 12 which is opened to the outside of the housing 1 and, into the opening 12, there can be fitted a package rubber plug 23 including three pressure holes 24 into which three shielding wires 30 as shown in FIG. 4 can be pressure inserted respectively. Further, a back retainer 25 can be placed on the outer surface of the housing 1 from behind the opening 12 to thereby cover or close the opening 12. In the back retainer 25, there are formed not only three insertion holes 26 through which their associated shielding wires 30 can be respectively inserted, but also two securing holes 27; and, if the securing holes 27 are respectively secured to two securing projections 13 which are respectively disposed on the upper and lower surfaces of the housing 1, then the back retainer 25 can be held on the outer surface of the housing 1.

Figure 5:
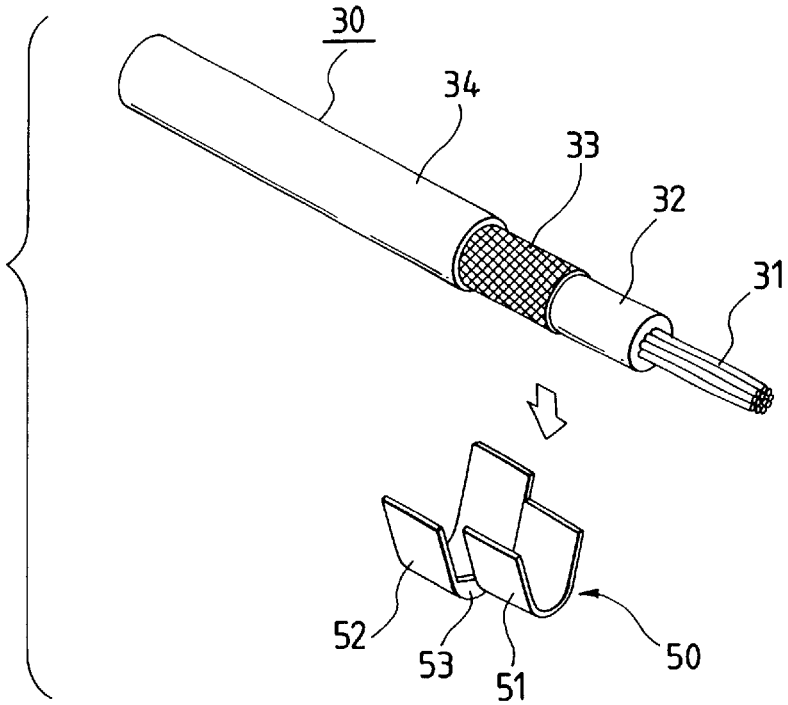
FIG. 5 is an exploded perspective view of a shielding wire and a shell connecting terminal, showing an operation to place the shielding wire onto the shell connecting terminal.

Each of the shielding wires 30 to be connected to the thus structured shielding connector is structured such that, as shown in FIG. 5, a core wire 31 is covered by an insulating layer 32, the outer periphery of the insulating layer 32 is covered by a braided wire 33 which can be formed by braiding together a plurality of conductive metal wires, and the outer periphery of the braided wire 33 is further covered by an insulating coating 34. To the shielding wire 30, there can be connected two kinds of terminals, in particular, a flat type male terminal 40 and a shell connecting terminal 50.

Figure 6:
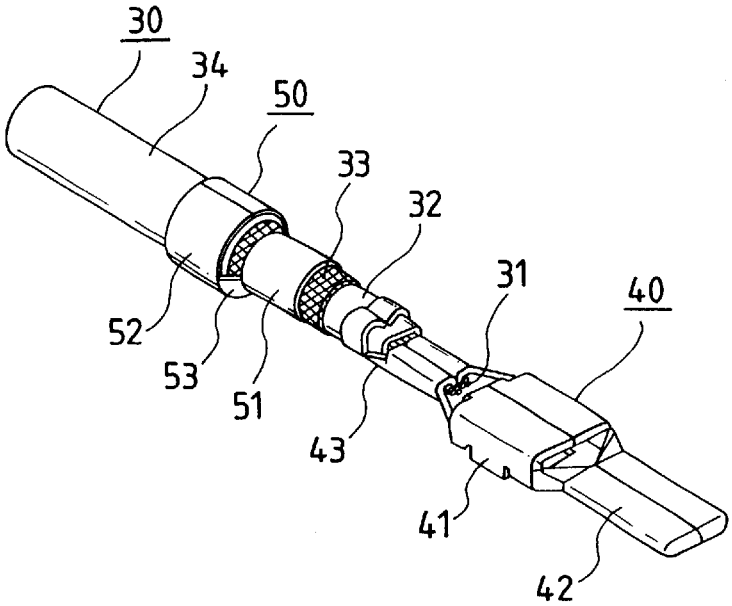
FIG. 6 is a perspective view of a shielding wire with a shell connecting terminal and a flat type male terminal mounted thereon.

Referring now to the structure of the flat type male terminal 40, as shown in FIG. 6, the flat type male terminal 40 comprises a main body portion 41 including a securing groove to which the lance 7 of the housing 1 can be secured, a tab 42 formed in front of the main body portion 41, and a caulking portion 43 formed in the rear of the main body portion 41. If the caulking portion 43 is caulked to the core wire 31, which is exposed as the insulating layer 32 of the shielding wire 30 is peeled off, then the flat type male terminal 40 can be connected to the core wire 31. Also, since the flat type male terminal 40 has a flat-type shape, it has an insertion direction limit with respect to the terminal storage chamber 5 in the peripheral direction thereof, while the terminal storage chamber 5 is so formed as to have a substantially rectangular section.

On the other hand, the shell connecting terminal 50 is structured such that, as shown in FIG. 5, a metal plate is divided to two U-shaped portions differing in size from each other: in particular, the smaller one of the two U-shaped portions is used as a braided wire connecting portion 51, while the larger one is used as a shell connecting portion 52; and, the two U-shaped portions 51 and 52 are connected together by a connecting portion 53 to thereby form the shell connecting terminal 50. The braided wire connecting portion 51 is mounted onto the braided wire 33 which is exposed with the insulating coating 34 peeled off, the shell connecting portion 52 is mounted onto the insulating coating 34 in the rear of the braided wire connecting portion 51, and then the two connecting portions 51 and 52 are respectively turned into annular shapes by a jig (see FIG. 6). Also, the braided wire 33 and shell connecting portion 52 can be electrically connected together by the connecting portion 53.

Figure 7:
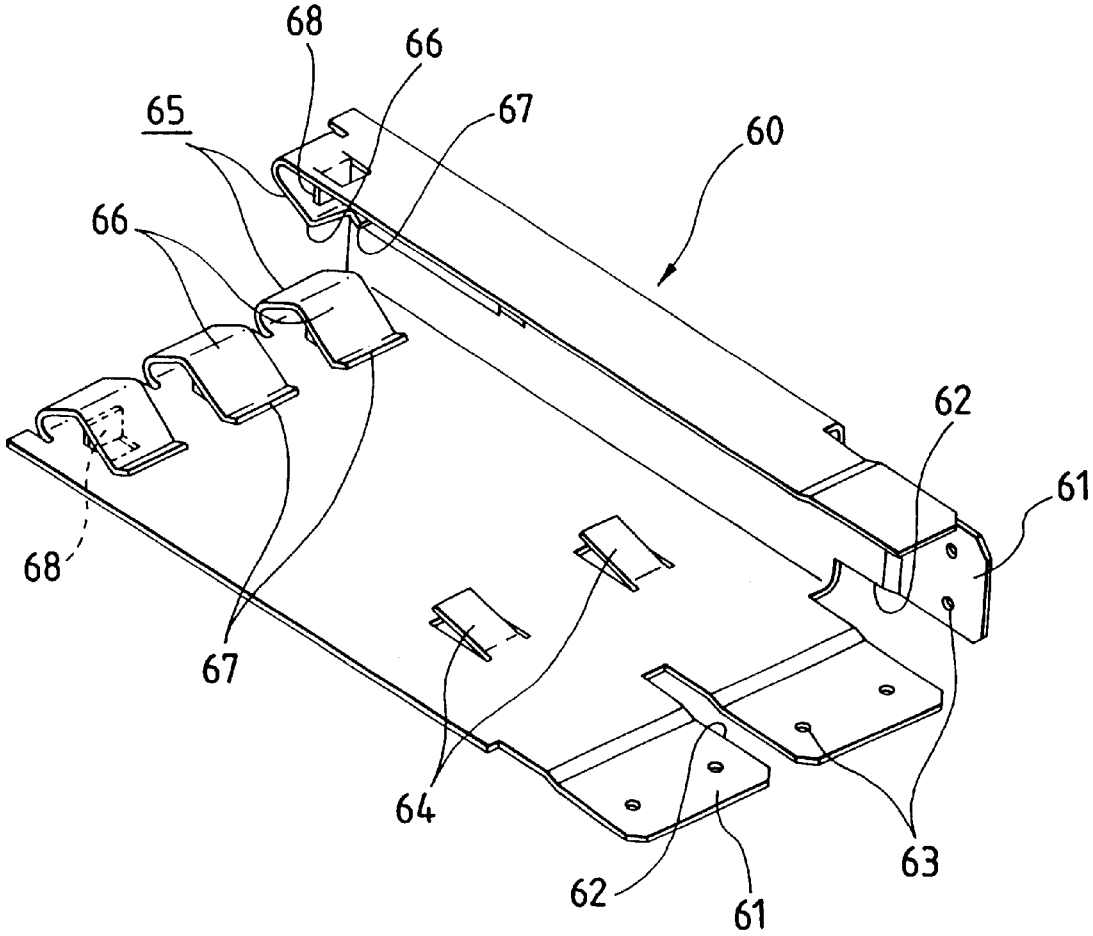
FIG. 7 is a partially cutaway perspective view of a prismatic-shaped shielding shell.

Here, description will be given below in detail of the structure of the prismatic-shaped shielding shell 60. That is, the prismatic-shaped shielding shell 60, as shown in FIG. 7, can be produced by forming a conductive metal plate into a prismatic shape.

In particular, the prismatic-shaped shielding shell 60 includes a fitting portion 61 formed in the front end portion thereof. At six positions of the fitting portion 61, there are formed six insertion grooves 62 which, when the prismatic-shaped shielding shell 60 is mounted onto the housing 1, can be moved through the support portion 4 and projected into the forwardly located, fitting recessed portion 9. In the leading end portion of the fitting portion 61, there are disposed a plurality of projecting portions 63 which are respectively formed by striking the corresponding portions of the fitting portion 61 leading end portion, thereby being able to enhance the mutual contact pressure between the present fitting portion 61 and a shielding shell disposed in the female-side housing when they are fitted with each other. Slightly in the rear of the fitting portion 61, there are disposed securing pieces 64 by twos on each of the upper and lower surfaces of the prismatic-shaped shielding shell 60, that is, a total of four securing pieces 64; in particular, they are so formed as to extend inwardly from their respective front portions in a cantilever manner. The securing pieces 64, when the prismatic-shaped shielding shell 60 is mounted onto the housing 1, can be respectively secured to securing portions 14 which are respectively formed in the inner tube portion 3 (see FIG. 1).

And, on the inner periphery of the rear end portion of the prismatic-shaped shielding shell 60, there are disposed a plurality of elastic tongue pieces 65. Each of the elastic tongue pieces 65 is formed by turning back an extension piece, which is so formed as to extend backward from the rear end edge of the prismatic-shaped shielding shell 60, inwardly of the prismatic-shaped shielding shell 60; and, the turned-back portion or the elastic tongue piece 65 is formed in an angular shape with a central portion 66 thereof as a top portion, while the end portion 67 thereof is so arranged as to be slightly distant from the inner peripheral surface of the prismatic-shaped shielding shell 60, whereby the elastic tongue piece 65 can be deformed elastically. Also, the elastic tongue pieces. 65 are to be disposed in the rear end portion of the shell connecting terminal storage chamber 10 within the housing 1.

And, there are formed a plurality of restrict pieces 68 on the portions of the inner peripheral surface of the prismatic-shaped shielding shell 60 that are respectively covered by their associated elastic tongue pieces 65 by cutting and raising these portions from the inner peripheral surface of the prismatic-shaped shielding shell 60; and, the restrict pieces 68 are respectively so disposed as to be slightly distant from the central portions 66 of their associated elastic tongue pieces 65, so that the restrict pieces 68 are able to restrict the excessive flexing deformation of their associated elastic tongue pieces 65.

Referring further to the arrangement of the thus shaped elastic tongue pieces 65, three elastic tongue pieces 65 are disposed side by side on the lower surface of the prismatic-shaped shielding shell 60 and, on the upper surface thereof which is opposed to the present lower surface, similarly, three elastic tongue pieces 65 are disposed side by side. In this arrangement, the width between the central portions 66 of the upper and lower elastic tongue pieces 65 is set smaller than the width of the shell connecting portion 52 of the shell connecting terminal 50 (see FIG. 3).

The present embodiment has the above-mentioned structure and, next, description will be given below of the assembling procedures of the present embodiment.

At first, as shown in FIG. 4, the shielding wires 30 are respectively inserted into the insertion holes 26 of the back retainer 25 and the pressure insertion holes 24 of the package rubber plug 23; and, after then, the insulating layer 32 and insulating coating 34 are removed, and the shell connecting terminal 50 and flat type male terminal 40 are then mounted sequentially.

To mount the shell connecting terminal 50, as shown in FIG. 5, the portions of the shielding wires 30 that correspond to the braided wires 33 are respectively positioned in the bottom portions of the braided wire connecting portions 51 of the shell connecting terminals 50, while the portions of the shielding wires 30 that correspond to the insulating coatings 34 are respectively positioned in the bottom portions of the shell connecting portions 52 of the shell connecting terminals 50. And, the braided wire connecting portions 51 and shell connecting portions 52 of the shell connecting terminals 50 are respectively caulked using a jig. As a result of this, as shown in FIG. 6, not only the braided wire connecting portions 51 and shell connecting portions 52, which have respectively had the U-like shapes, are turned into annular shapes, but also they can be easily mounted to the braided wires 33 and insulating coatings 34 respectively.

After then, if the caulking portions 43 of the flat type male terminals 40 are respectively caulked to the core wires 31 of the shielding wires 30, then the flat type male terminals 40 can be respectively mounted to the shielding wires 30. At the then time, since the shell connecting portion 52 mounted prior to the flat type male terminal 40 is formed in an annular shape and thus the shell connecting portion 52 has no direction limit problem in the peripheral direction thereof when it is connected to the elastic tongue pieces 65 of the prismatic-shaped shielding shell 60, the connecting operation of the flat type male terminal 40 can be executed without paying special attention to the connecting position of the shell connecting terminal 50 in the peripheral direction thereof.

Figure 3:
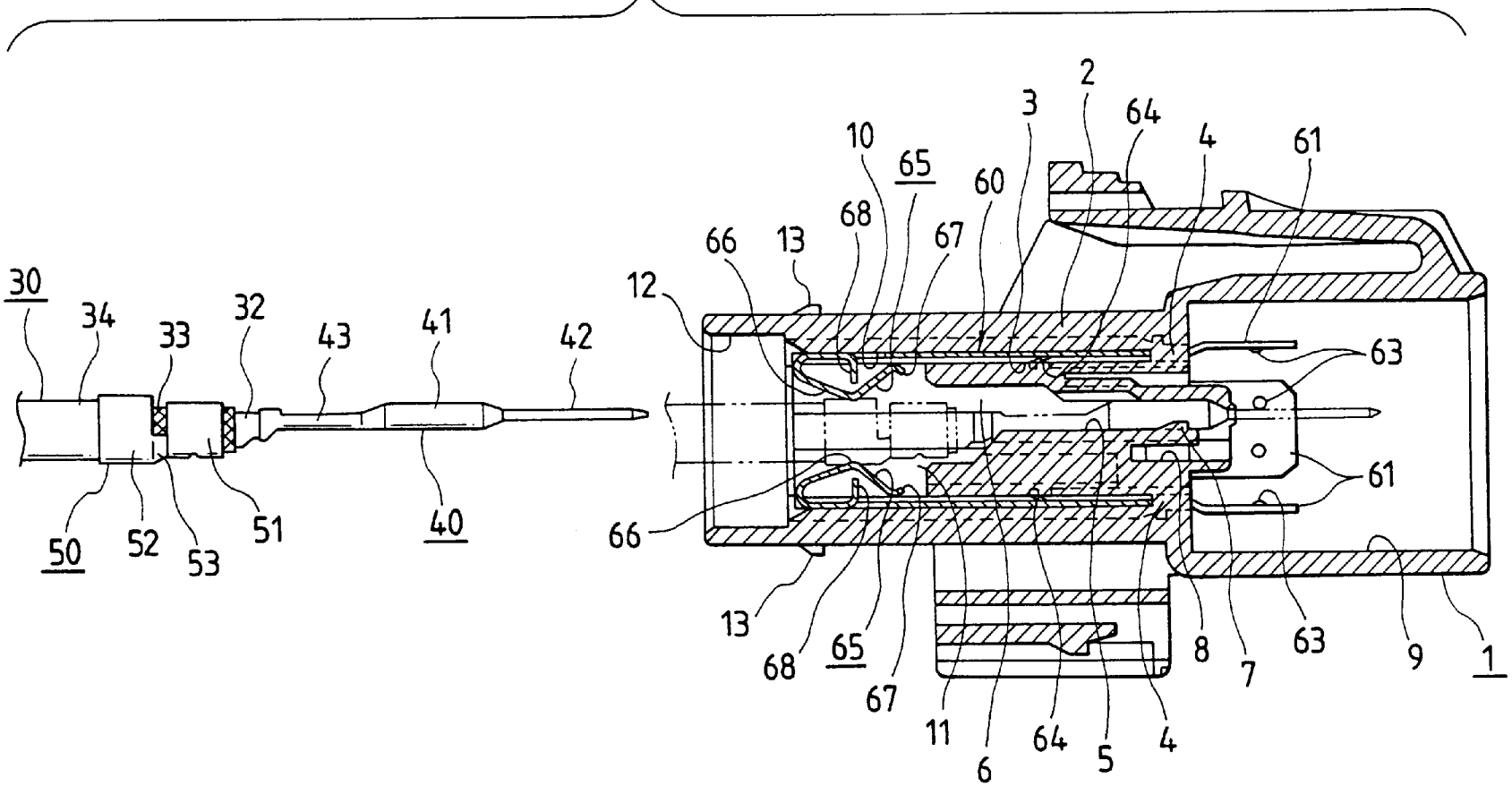
FIG. 3 is a partially cutaway side view of the shielding connector, showing an operation to insert a shielding wire into a housing.

And, as shown in FIG. 3, the shielding wires 30 each having the shell connecting terminal 50 and flat type male terminal 50 mounted thereon are respectively inserted into he housing 1 with the prismatic-shaped shielding shell 60 mounted therein. The flat type male terminal 40 is inserted from the opening 12 formed on the rear end side of the housing 1 into the terminal storage chamber 5 while the insertion direction thereof in the peripheral direction is being adjusted, the tabs 42 of the shielding wires 30 are respectively projected into the fitting recessed portion 9, and the lances 7 of the housing 1 are secured to the securing grooves of the main body portions of the shielding wires 30, thereby completing the insertion of the shielding wires 30.

Here, when the shell connecting portion 52 of the shell connecting terminal 50 is inserted into the shell connecting terminal storage chamber 10, not only it is contacted with the respective central portions 66 of the two elastic tongue pieces 65 mutually opposingly disposed on the upper and lower surfaces of the prismatic-shaped shielding shell 60 but also it causes the two elastic tongue pieces 65 to deform elastically in the upward and downward directions respectively. As a result of this, the shell connecting portion 52 can be inserted into between and held by the central portions 66. In this case, the shell connecting portion 52 can be held stably by the elastic forces of the central portions 66 and, at the same time, the stably connected condition of the shell connecting portion 52 can be kept on. Thus, the braided wires 33 of the shielding wires 30 can be electrically connected with the prismatic-shaped shielding shell 60 through the shell connecting terminals 50, so that the core wires 31 of the shielding wires 30 can be shielded positively within the housing 1 as well.

After the shielding wires 30 are respectively inserted into the housing 1, as shown in FIG. 2, if the package rubber plug 23, back retainer 25, and front retainer 20 are respectively mounted on the housing 1, then the assembly of the shielding connector can be completed.

As has been described heretofore, according to the present embodiment, the provision of the elastic tongue pieces 65 on the prismatic-shaped shielding shell 60 allows use of an annular-shaped shell connecting portion 52 as the shell connecting portion 52 of the shell connecting terminal 50 for connecting the prismatic-shaped shielding shell 60 and the braided wires 33 of the shielding wires 30 to each other, which in turn can eliminate the insertion direction limit of the shell connecting portion 52 with respect to the prismatic-shaped shielding shell 60. Due to this, when the shell connecting terminal 50 and flat type male terminal 50 are connected sequentially to the shielding wire 30, the flat type male terminal 40 can be connected without paying special attention to the connecting position of the shell connecting terminal 50 in the peripheral direction thereof, which makes it possible to simplify the terminal connecting operation. Also, even when the above-mentioned connecting order is reversed, that is, even when the shell connecting terminal 50 is connected after completion of connection of the flat type male terminal 40, there can also be obtained a similar effect.

And, the size of the elastic tongue piece 65 provided on the prismatic-shaped shielding shell 60 can be set freely unless it interferes the insertion of the shielding wire 30 and, therefore, the elastic tongue piece 65 is allowed to have a relatively large elastic force, so that the elastic tongue piece 65 is able to hold the shell connecting portion 52 in a more stable condition.

Also, since the shell connecting portion 52 of the shell connecting terminal 50 is structured such that it does not include an outwardly projecting portion, even when the shielding wire 30 is wound while the shell connecting terminal 50 is mounted on the shielding wire 30, the insulating coating 34 of the shielding wire 30 is more difficult to be damaged.

Further, because the elastic tongue pieces 65 are disposed on the upper and lower surfaces of the prismatic-shaped shielding shell 60 in such a manner that the upper and lower elastic tongue pieces 65 are opposed to each other, the contact pressure of the elastic tongue pieces 65 with respect to the shell connecting portion 52 is enhanced. This not only makes it possible to hold the shell connecting portion 52 positively, but also, even when vibrations or shocks are applied to the prismatic-shaped shielding shell 60, the stable contact of the elastic tongue pieces 65 with respect to the shell connecting portion 52 can be secured.

[Second Embodiment]

Next, description will be given below of a second embodiment of a structure for treating the end portion of a shielding wire according to the invention with reference to FIGS. 8 to 12. In the present embodiment, the invention is applied to a shielding wire to be stored in a male-side shielding connector.

Figure 8:
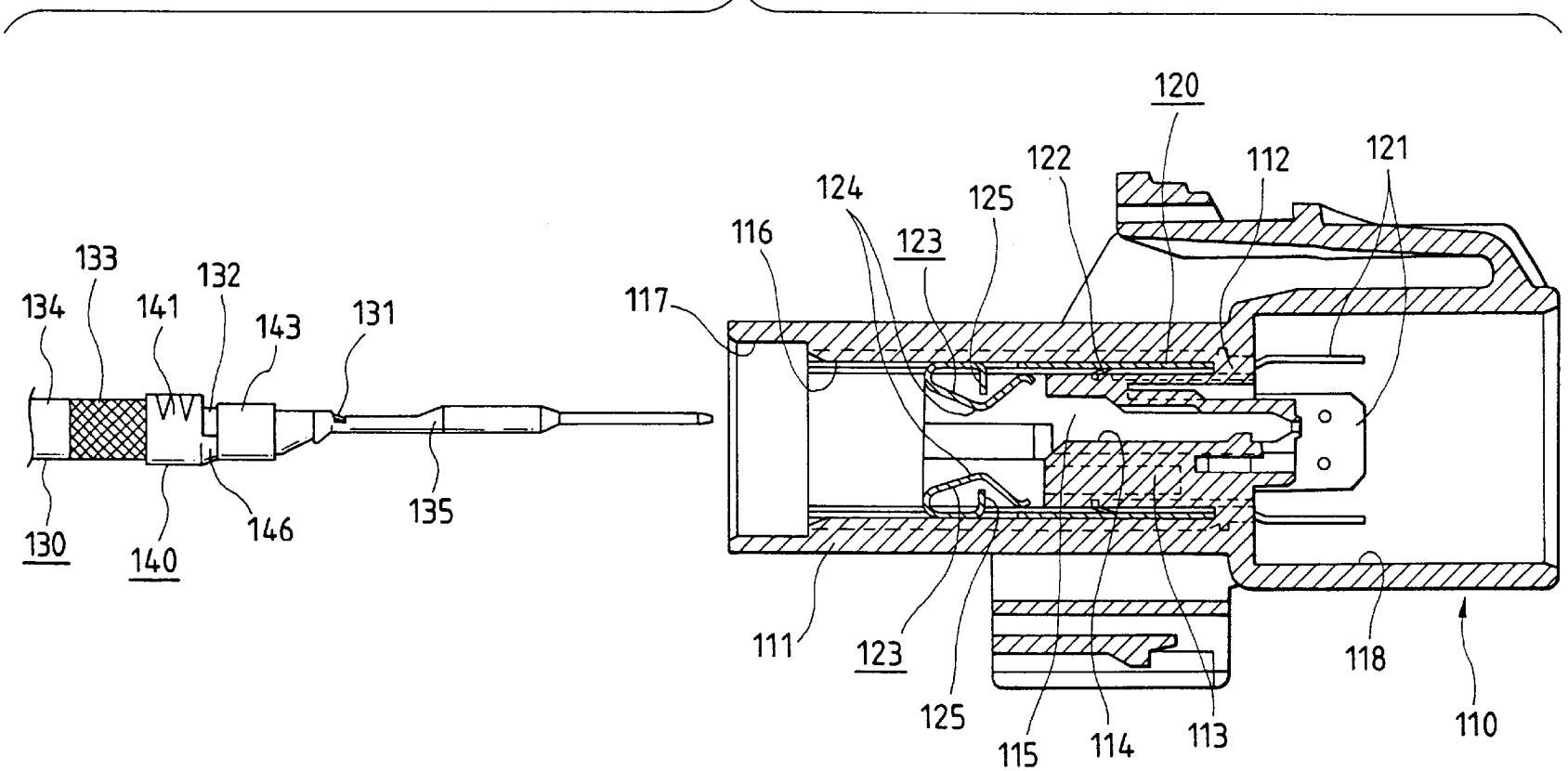
FIG. 8 is a partially cutaway side view of a shielding wire and a shielding connector according to a second embodiment of the invention.

The present male-side shielding connector, as shown in FIG. 8, comprises a double-structure connector housing 110 (which is hereinafter referred to as a housing 110) and a cylindrical-shaped shielding shell 120 stored within the housing 110.

The double structure of the housing 110 is composed of an outer tube portion 111 and an inner tube portion 113 located in the inside of the outer tube portion 111 through a support portion 112. In the inside of the inner tube portion 113, there are arranged three terminal storage chambers 114 side by side with side walls 115 between them, while three terminal metal members 135 respectively pressure attached to the terminals of their associated shielding wires 130 can be stored within the three terminal storage chambers 114. In the rear of the inner tube portion 113, in particular, in the outer tube portion 111, there are formed three connecting terminal storage chambers 116 which are respectively so formed as to be in communication with their associated terminal storage chambers 114; and, three connecting terminals 140 respectively caulked to their associated shielding wires 130 (which will be discussed later) can be stored in their respective connecting terminal storage chambers 116. In the rear of the connecting terminal storage chambers 116, there is formed an opening 117 into which a rubber plug 126 can be pressure inserted; and, a hold part 127 for prevention of the rubber plug 126 against removal can be mounted on the outer tube portion 111 in such a manner that it can cover the rear end of the outer tube portion 111 (see FIG. 12). Also, on the front end side of the outer tube portion 111, there is opened up a fitting recessed portion 118 into which a female housing (not shown) can be fitted.

Between the outer and inner tube portions 111 and 113, there is mounted the cylindrical-shaped shielding shell 120.

The present shielding shell 120 is formed of a conductive metal plate and is disposed in such a manner that the fitting portions 121 of the shielding shell 120, which respectively provide the front end portion of the shielding shell 120 when the shielding shell 120 is stored within the housing 110, are projected into the fitting recessed portion 118 of the housing 110; and, if the fitting portions 121 are fitted with the shielding portion of the female housing, then the shielding shell 120 can be connected with the female housing. Inwardly from the upper and lower surfaces of the portion of the shielding shell 120 that is held by the outer and inner tube portions 111 and 113 of the housing 110, there are projected two securing pieces 122 in a cantilever manner, while the securing pieces 122 can be secured to securing portions formed on the outer peripheral surface of the inner tube portion 113.

In the inside of each of the connecting terminal storage chambers 116, there are provided elastic tongue pieces 123 in such a manner that they are turned back inwardly from their associated upper and lower surfaces of the connecting terminal storage chambers 116. Referring in more particular to the structure of each of the elastic tongue pieces 123, the central portion thereof is projected inwardly to thereby provide a top portion 124 so that the elastic tongue piece 123 can be formed in an angular shape; and, if the top portion 124 is pressed outward, then the elastic tongue piece 123 can be flexed and deformed outward. From the outside of the top portion 124, there is disposed a restrict piece 125 by cutting and raising the corresponding portion of the top portion 124 outside, and the leading end portion of the restrict piece 125 is set at a position slightly distant from the top portion 124 of the elastic tongue piece 123, thereby being able to restrict the excessive flexing deformation of the elastic tongue piece 123.

Figure 9:
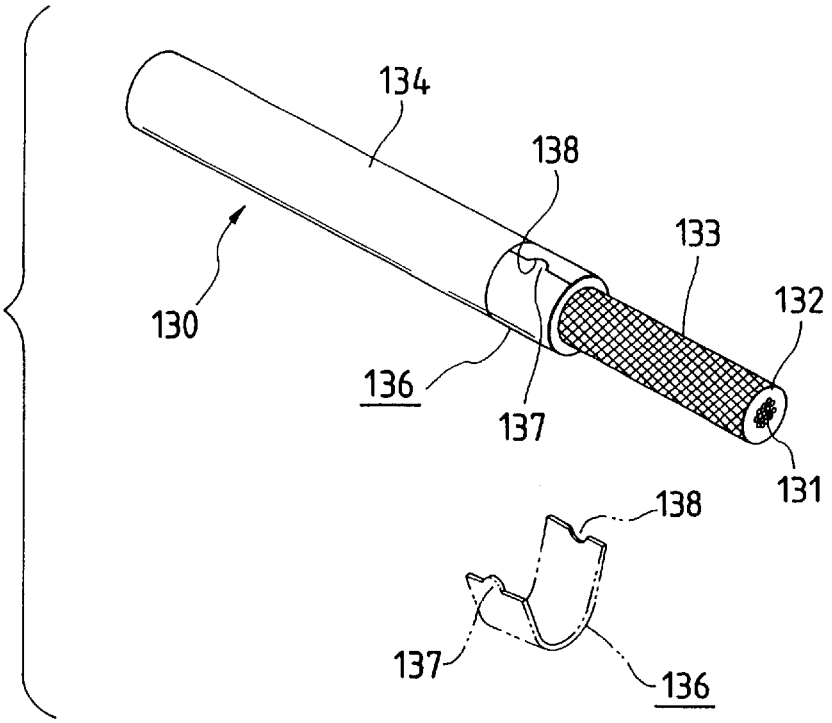
FIG. 9 is a perspective view of a shielding wire, showing an operation to mount a receiving tube portion onto the shielding wire.

Now, description will be given below of the shielding wire 130 to be inserted into the housing 110. The shielding wire 130 is structured in such a manner as shown in FIG. 9: that is, a core wire 131 formed by bundling together a plurality of metal wires is covered with an insulating coating 132 formed of insulating resin material, a braided wire 133 formed by braiding together a plurality of fine wires is placed on the outer periphery of the insulating coating 132, and further the outer periphery of the braided wire 133 is covered by an outer coating 134 formed of insulating resin material. In the thus structured shielding wire 130, if the outer coating 134 is peeled off or removed by a given width in the end portion thereof, then the braided wire 133 can be exposed.

Figure 10:
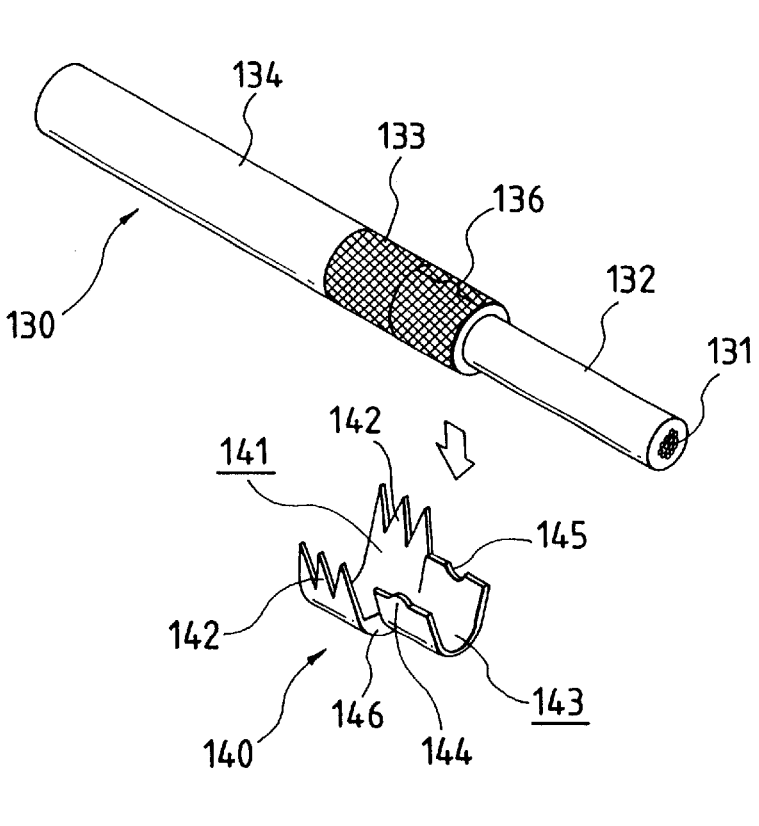
FIG. 10 is a perspective view of a shielding wire, showing an operation to mount a connecting terminal onto the shielding wire.

A receiving tube portion 136 can be caulked to the front end portion of the outer coating 134 of the shielding wire 130. The receiving tube portion 136 is made of a U-shaped metal plate; in the respective central portions of the two open ends of the receiving tube portion 136, there are formed semi-circular projecting portion 137 and recessed portion 138 in a mutually opposing manner; and, when the receiving tube portion 136 is caulked, the projecting and recessed portions 137 and 138 can be fitted with each other. After the receiving tube portion 136 is mounted on the shielding wire 130, as shown in FIG. 10, the braided wire 133 is turned back to the outer peripheral side of the outer coating 134.

Now, in a state where the braided wire 133 is turned back, a connecting terminal 140 for connecting the braided wire 133 to the shielding shell 120 can be mounted by caulking onto the shielding wire 130. The connecting terminal 140, as shown in FIG. 10, is composed of two U-shaped portions having different sizes which can be formed by dividing a metal plate into two: in particular, the larger one of the two U-shaped portions is used as a braided wire contact portion 141, whereas the smaller one is used as a shell contact portion 143; and, the braided wire contact portion 141 and shell contact portion 143 are connected together by a connecting portion 146 interposed between them to thereby construct the whole connecting terminal 140. The connecting portion 146 is inclined obliquely with respect to the axial direction of the shielding wire 130 in order to be able to form a level difference or a stepped portion of a given width between the braided wire contact portion 141 and shell contact portion 143, while the shell contact portion 143 is disposed at a higher position than the braided wire contact portion 141. The width of the stepped portion is set almost equal to the thickness of the outer coating 134 of the shielding wire 130.

The braided wire contact portion 141 can be caulked from above to the portion of the shielding wire 130 to which the receiving tube portion 136 has been caulked, on the side of the portion of the shielding wire 130 where not only the outer coating 134 remains unpeeled off but also the braided wire 133 is turned back. And, there are disposed fitting pieces 142 by threes in each of the respective central portions of the two open ends of the braided wire contact portion 141 in such a manner that the fitting pieces 142 on the two end sides are respectively opposed to each other. Each of the six fitting pieces 142 is formed in an isosceles triangle shape, as it were, in an angular shape. By the way, the fitting piece 142 located in the rear end of one side as well as the fitting piece 142 located in the front end of the other side are respectively formed in size as one half of the remaining fitting pieces 142. The shell contact portion 143 is structured such that, in a state where it is caulked to the shielding wire 130, the fitting pieces 142 on one side can be respectively fitted with their associated trough-shaped portions which are respectively formed between their opposing fitting pieces 142 on the other side (see FIG. 11).

The shell contact portion 143 can be caulked on the side of the shielding wire 130 where the outer coating 134 is removed and the insulating coating 132 is thereby exposed. In the respective central portions of the two open ends of the shell contact portion 143, there are disposed semicircular-shaped projecting and recessed portions 144 and 145 in a mutually opposing manner; and, in a state where the shell contact portion 143 is caulked to the shielding wire 130, the projecting and recessed portions 144 and 145 can be fitted with each other (see FIG. 11). The shell contact portion 143 is structured such that, in the thus caulked state thereof, the outside diameter thereof becomes larger than the distance between the mutually opposing elastic tongue pieces 123 respectively disposed on the upper and lower surfaces of the shielding shell 120.

The present embodiment is structured in the above-mentioned manner and, next, description will be given below of the end portion treating operation of the shielding wire 130 as well as the assembling operation of the housing 110 which will be carried out after completion of the end portion treating operation of the shielding wire 130.

At first, as shown in FIG. 9, the outer coating 134 existing on the end portion of the shielding wire 130 is peeled off or removed to thereby expose the braided wire 133. After then, the receiving tube portion 136 is applied onto the front end portion of the outer coating 134 that is formed by the previous operation, and the receiving tube portion 136 is then caulked to the outer coating 134 front end portion using a jig or the like.

Next, as shown in FIG. 10, the braided wire 133 covering the insulating coating 132 is turned back to the outer peripheral side of the outer coating 134. Due to this, not only the receiving tube portion 136 caulked to the outer coating 134 and the outer peripheral surface of the outer coating 134, which is located backwardly of the receiving tube portion 136, can be covered by the braided wire 133, but also the insulating coating 132 on the outer coating 134 removed side of the shielding wire side can be exposed.

Figure 11:
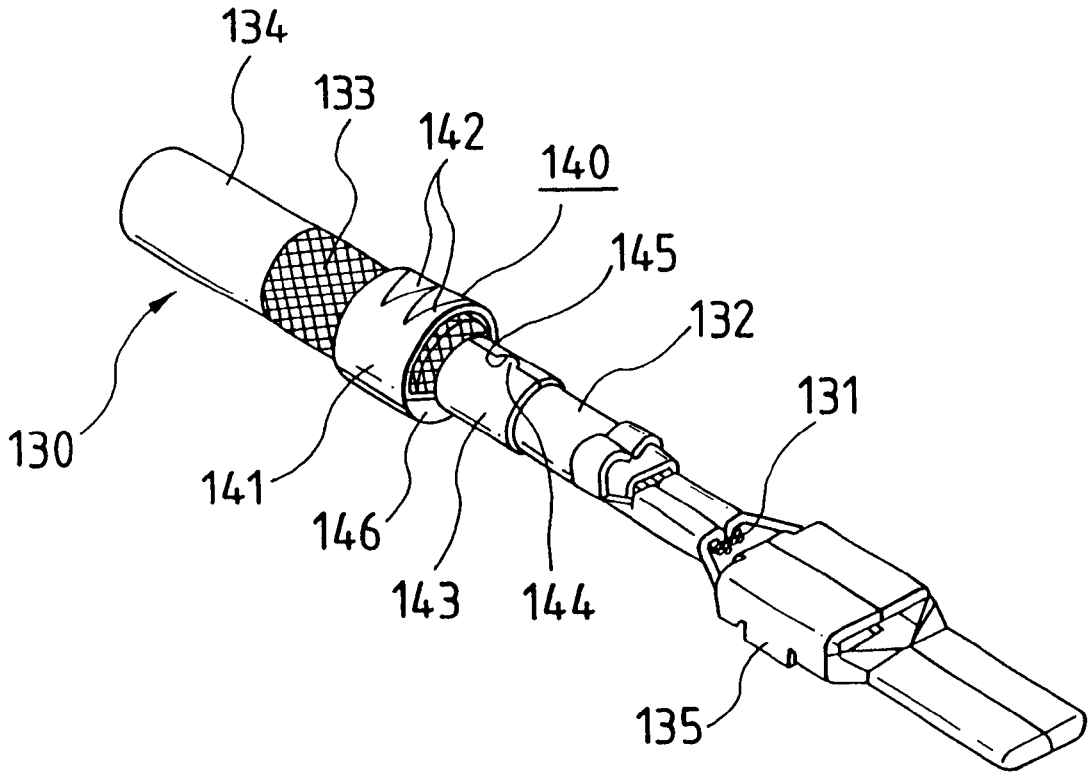
FIG. 11 is a perspective view of a shielding wire, showing a state thereof in which the end portion treatment of the shielding wire is completed.

After then, the connecting terminal 140 is caulked to the shielding wire 130. In particular, while not only positioning the braided wire contact portion 141 of the connecting terminal 140 in the portion of the shielding wire 130 to which the receiving tube portion 136 is caulked, but also positioning the shell contact portion 143 of the connecting terminal 140 in the insulating coating 132 with the outer coating 134 removed therefrom, the connecting terminal 140 is applied to the shielding wire 130; and, after then, as shown in FIG. 11, the braided wire contact portion 141 and shell contact portion 143 of the connecting terminal 140 are respectively caulked to their associated portions of the shielding wire 130 using a jig or the like.

Here, when caulking the braided wire contact portion 141, since only the good contact condition thereof with respect to the braided wire 133 can be considered, the braided wire contact portion 141 can be caulked with such a strong caulking force that can crush the braided wire contact portion 141 to thereby reduce the outside diameter thereof, whereby an ideal contact condition can be realized between the braided wire contact portion 141 and the braided wire 133. Further, as described above, on the two open ends of the braided wire contact portion 141, there are disposed the mutually opposing, angular-shaped fitting pieces 142 and, when the fitting pieces 142 are respectively fitted with their associated trough-shaped portions on their mutually opposing sides, the fitting pieces 142 bite at the braided wire 133 and outer coating 134, thereby being able to enhance the contact of the braided wire contact portion 141 with respect to the braided wire 133 still further.

On the other hand, when caulking the shell contact portion 143, since only the good contact condition thereof with respect to the elastic tongue pieces 123 of the shielding shell 120 can be considered, if a caulking force used to caulk the shell contact portion 143 is adjusted to a level to be able to flex and deform the elastic tongue pieces 123 in such a manner that the outside diameter of the shell contact portion 143 can be larger than the distance between the mutually opposing elastic tongue pieces 123 respectively disposed on the upper and lower surfaces of the shielding shell 120, then the outside diameter of the shell contact portion 143 can be kept constant.

Also, since the braided wire contact portion 141 is caulked to the side of the shielding wire 130 with the outer coating 134 remaining unpeeled and the shell contact portion 143 is caulked to the side of the shielding wire 130 with the outer coating 134 removed therefrom, the braided wire contact portion 141 and shell contact portion 143 are so disposed as to be distant from each other by a stepped portion equivalent to the thickness of the outer coating 134. In correspondence to this, the braided wire contact portion 141 and shell contact portion 143 are connected together through the connecting portion 146 which is so disposed obliquely as to have the same width as the width of the stepped portion. Therefore, even if there is applied to the shielding wire 130 a force which pushes the shielding wire 130 from the side thereof where the outer coating 134 is left unpeeled, the connecting portion 146 of the connecting terminal 140 is caught by the outer coating 134 of the shielding wire 130, thereby being able to prevent the connecting terminal 140 from being shifted or removed in the axial direction thereof.

After the connecting terminal 140 is caulked or mounted, the front end portion of the insulating coating 132 is peeled off by a given width to thereby expose the core wire 131, and the terminal metal member 135 is pressure attached to the thus exposed core wire 131 portion. This completes the end portion treating operation of the shielding wire 130.

Figure 12:
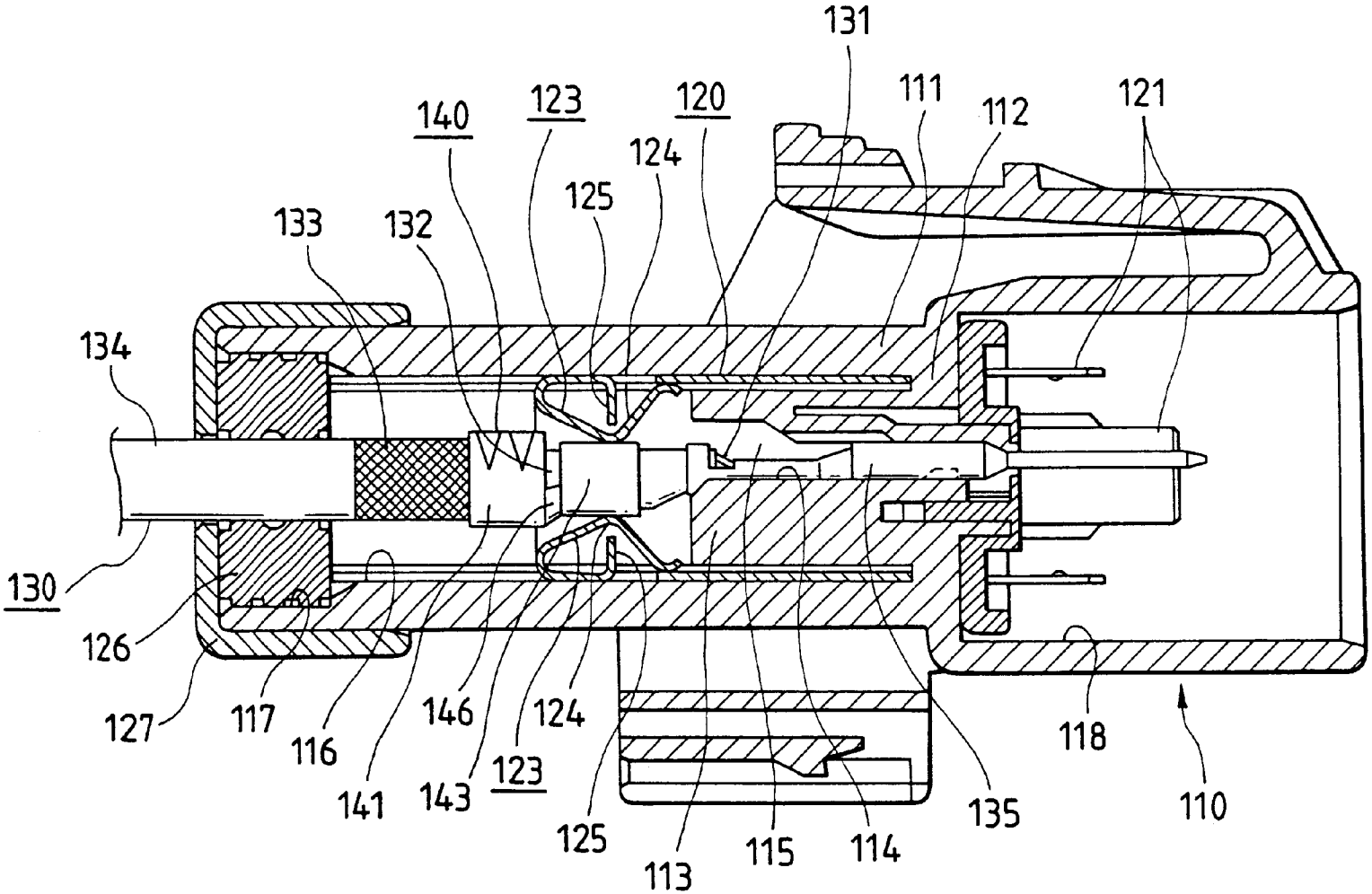
FIG. 12 is a partially cutaway side view of a shielding wire and a shielding connector according to a second embodiment of the invention, showing a state thereof in which the shielding wire is stored in a housing of the shielding connector.

Next, as shown in FIGS. 8 and 12, the shielding wire 130 with the connecting terminal 140 and terminal metal member 35 mounted thereon is inserted into the housing 110 from behind. The terminal metal member 135 is stored into the terminal storage chamber 114 and, at the same time, the leading end portion thereof is passed through the terminal storage chamber 114 and is projected into the fitting recessed portion 118 located forwardly of the terminal storage chamber 114. On the other hand, the connecting terminal 140 is passed through the opening 117 and is stored into the connecting terminal storage chamber 116. In this operation, the shell contact portion 143 of the connecting terminal 140 is contacted with the top portion 124 of the elastic tongue piece 123 of the shielding shell 120 and, while pushing out the top portion 124 outwardly, the shell contact portion 143 is inserted into the deep portion of the shielding shell 120. Due to this, while the elastic tongue piece 123 is being flexed and deformed outwardly, the shell contact portion 143 is held in an elastic manner. Since, in the caulking stage, the outside diameter of the shell contact portion 143 is set to be larger at the then time than the distance between the mutually opposing elastic tongue pieces 123 of the shielding shell 120, the shell contact portion 143 can be held by and between these elastic tongue pieces 123 with a sufficient contact pressure, thereby being able to keep the shell contact portion 143 and shielding shell 120 in a good mutual contact state.

After then, if the rubber plug 126 is pressure inserted into the opening 117 of the housing 110 and the hold portion 127 is fitted with the rear end portion of the outer tube portion 111, then the assembling operation of the housing 110 can be completed.

As has been described hereinbefore, according to the present embodiment, since the connecting terminal 140 is formed such that it is divided into the braided wire contact portion 141 for contact with the braided wire 133 of the shielding wire 130 and the shell contact portion 143 for contact with the shielding shell 120 within the housing 110, when caulking the braided wire contact portion 141 to the shielding wire 130, the braided wire contact portion 141 can be caulked with a sufficient caulking force with no consideration for the outside diameter of the braided wire contact portion 141, which makes it possible to establish an ideal contact state between the braided wire contact portion 141 and braided wire 133. At the same time, when caulking the shell contact portion 143 to the shielding wire 130, the outside diameter of the shell contact portion 143 can be set such that, with no consideration for the close contact state of the shell contact portion 143 with respect to the shielding wire 130, the shell contact portion 143 causes the elastic tongue piece 123 of the shielding shell 120 to flex and deform and thus the shell contact portion 143 can be held by the elastic tongue piece with a sufficient elastic contact pressure, thereby being able to realize an ideal contact state between the shell contact portion 143 and shielding shell 120. That is, since the connecting terminal 140 is divided into the braided wire contact portion 141 and shell contact portion 143 and they are respectively caulked to the shielding wire 130 at different positions in the axial direction of the shielding wire 130, the braided wire 133 of the shielding wire 130 and shield shell 120 can be connected to each other in an ideal manner.

Also, between the braided wire contact portion 141 and shell contact portion 143, there is formed the stepped portion having the same width as the thickness of the outer coating 134 of the shielding wire 130 by means of the connecting portion 146 and, at the same time, the braided wire contact portion 141 is caulked to the side of the shielding wire 130 where the outer coating 134 is left unpeeled, whereas the shell contact portion 143 is caulked to the side of the shielding wire 130 where the outer coating 134 is peeled or removed. Thanks to this, even if there is applied to the shielding wire 130 a force to push in the shielding wire 130 from the side of the shielding wire 130 where the outer coating 134 is left unpeeled, the connecting portion 146 of the connecting terminal 140 is caught by the leading end of the outer coating 134 of the shielding wire 130, thereby being able to prevent the connecting terminal 140 from being shifted or removed in the axial direction thereof.

[Third Embodiment]

Next, description will be given below of a third embodiment of a structure for treating the end portion of a shielding wire according to the invention with reference to FIGS. 13 to 15. In the third embodiment, the invention is applied to a structure for caulking a connecting terminal 140A to a shielding wire 130 in which a braided wire 133 is not turned back.

Figure 13:
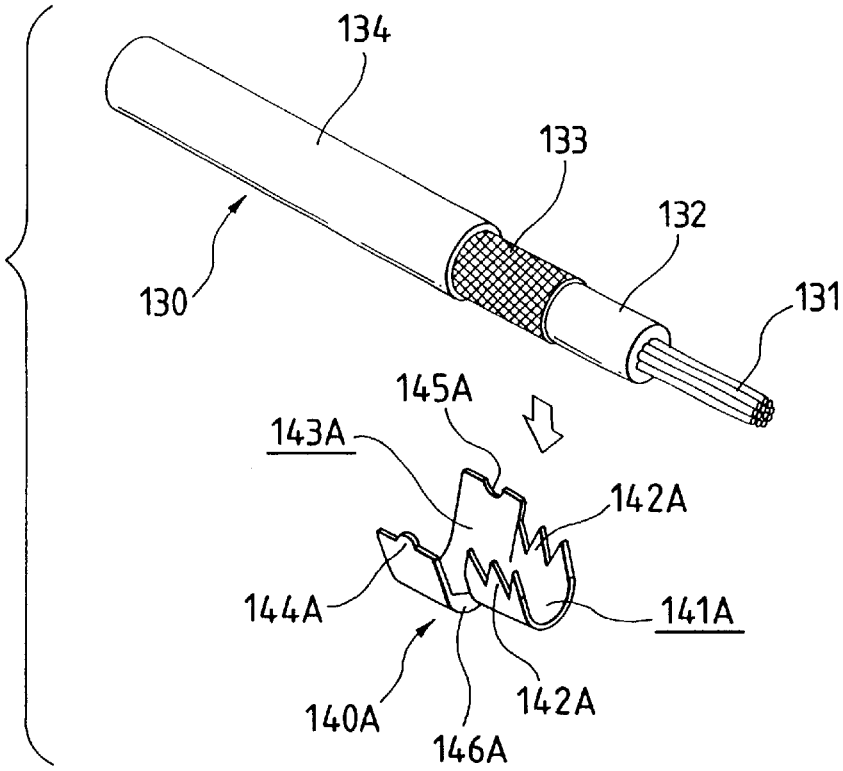
FIG. 13 is a partially cutaway side view of a shielding wire and a connecting terminal according to a third embodiment of the invention.

The end portion of the shielding wire 130, as shown in FIG. 13, is previously peeled off from the front portion thereof in such a manner that a core wire 131, an insulating coating 132, a braided wire 133 and outer coating 134 can be sequentially exposed in this order; and, the connecting terminal 140A is to be caulked to the thus peeled-off portion of the shielding wire 130.

The connecting terminal 140A is made of a metal plate and is composed of large and small U-shaped portions; and, in particular, the large portion is used as a braided wire contact portion 141A, whereas the small portion is used as a shell contact portion 143A. The braided wire contact portion 141A includes angular-shaped fitting pieces 142A disposed by threes on each of the two open ends thereof, while the shell contact portion 143A includes a semicircular-shaped projecting portion 144A and a semicircular-shaped recessed portions 145A formed in each of the two open ends thereof. The braided wire contact portion 141A and shell contact portion 143A are connected together by a connecting portion 146A which is so formed as to be inclined with respect to the axial direction of the shielding wire 130, while, between them, there is formed a stepped portion having a width equivalent to the thickness of the outer coating 134 of the shielding wire 130.

The remaining portions of the third embodiment are similar in structure to the previously described second embodiment. Accordingly, the parts thereof having the same functions as those in the second embodiment are given the same designations and thus the duplicate description thereof is emitted here.

Figure 14:
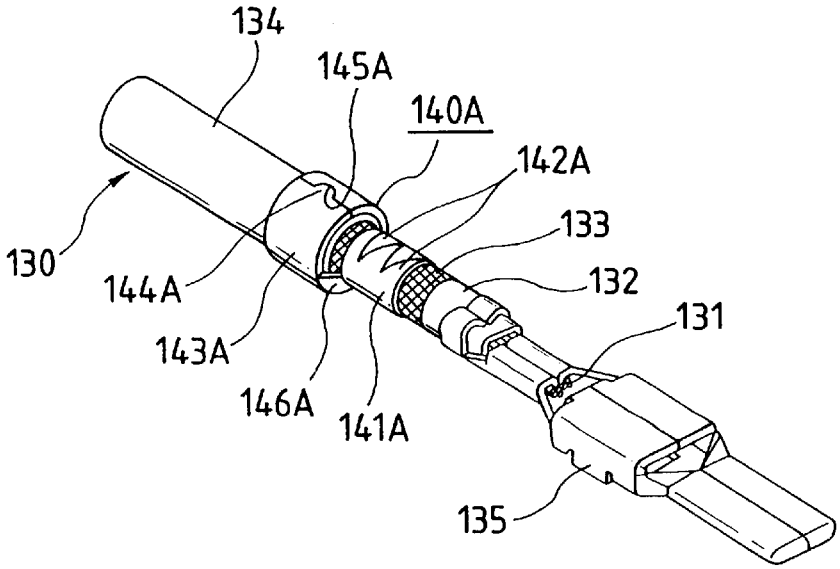
FIG. 14 is a perspective view of the shielding wire shown in FIG. 13, showing a state thereof in which the end portion treatment of the shielding wire is completed.

To caulk the connecting terminal 140A to the shielding wire 130, as shown in FIG. 13, the shell contact portion 143A of the connecting terminal 140A may be positioned on the outer coating 134 of the shielding wire 130 and the braided wire contact portion 141A thereof may be positioned on the braided wire 133 with the outer coating 134 peeled off therefrom; and, after then, the braided wire contact portion 141A and shell contact portion 143A may be respectively caulked to their associated portions of the shielding wire 130 in such a manner as shown in FIG. 14 using a jig or the like.

Figure 15:
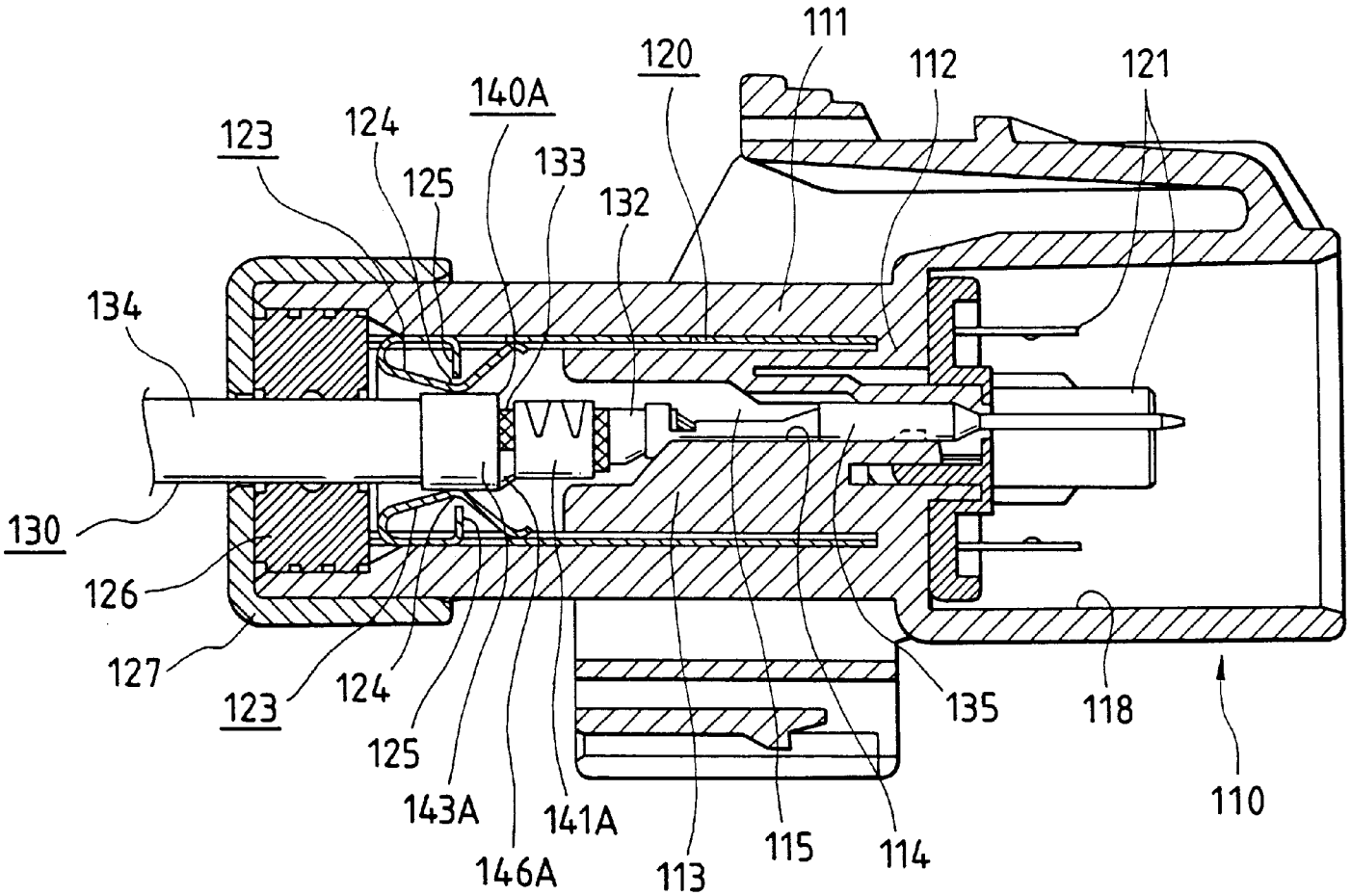
FIG. 15 is a partially cutaway side view of a shielding wire and a shielding connector according to the third embodiment of the invention, showing a state thereof in which the shielding wire is stored in a housing of the shielding connector.

Next, after the terminal metal member 135 is pressure attached to the core wire 131 of the shielding wire 130, as shown in FIG. 15, the shielding wire 130 is inserted into the housing 110. At the then time, since the shell contact portion 143A elastically held by and between the elastic tongue pieces 123 of the shielding shell 120 is caulked to the outer coating 134 of the shielding wire 130, the elastic tongue pieces 123 can be flexed to a great extent, whereby the shell contact portion 143A of the connecting terminal 140A can be held by and between the elastic tongue pieces 123 with a great contact pressure.

[Fourth Embodiment]

Next, description will be given below of a fourth embodiment of a structure for treating the end portion of a shielding wire according to the invention with reference to FIGS. 16 and 17. In the fourth embodiment, the present invention is applied to a case where, when compared with the second embodiment, the braided wire contact portion 141 and shell contact portion 143 of the connecting terminal 140 are connected together by a connecting portion 146 with no stepped portion between them.

Figure 16:
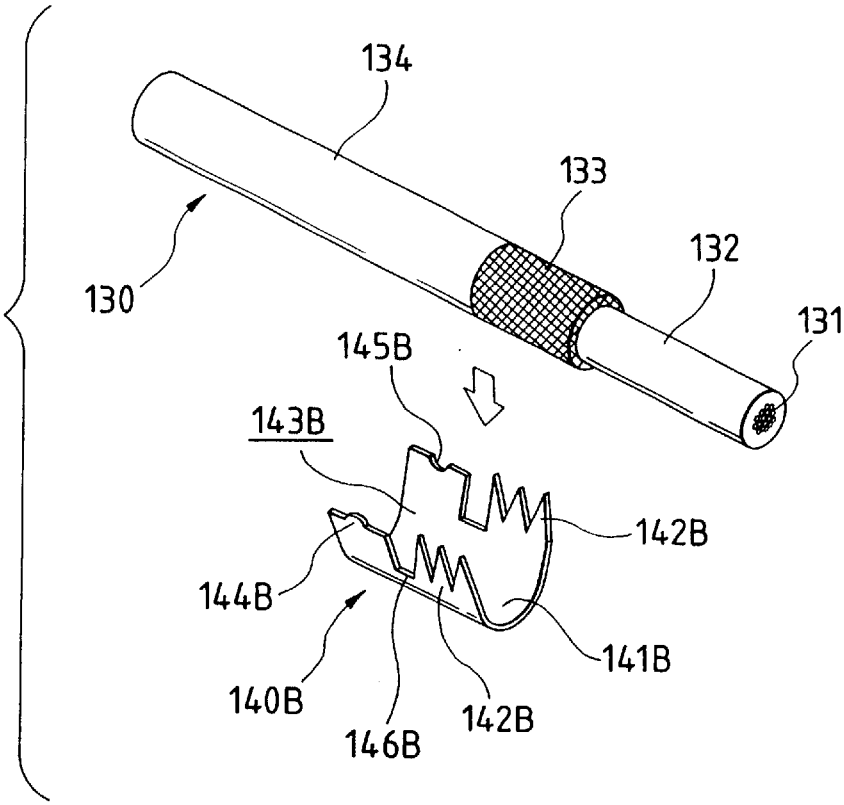
FIG. 16 is a partially cutaway side view of a shielding wire and a connecting terminal according to a fourth embodiment of the invention.

In particular, according to the present embodiment, a connecting terminal 140B, as shown in FIG. 16, is composed of two U-shaped portions having the same size; and, the U-shaped portion on this side is used as a braided wire contact portion 141B, whereas the U-shaped portion on the far side is used as a shell contact portion 143B. The braided wire contact portion 141B includes angular-shaped fitting pieces 142B disposed by threes on each of the two open ends thereof, whereas the shell contact portion 143B includes a semicircular-shaped projecting portion 144B and a semicircular-shaped recessed portion 145B formed in each of the two open ends thereof. The braided wire contact portion 141B and shell contact portion 143B of the connecting terminal 140B are connected together by a connecting portion 146 which so formed as to be horizontal with respect to the axial direction of the shielding wire 130 in such a manner that there exists no stepped portion between them.

The remaining portions of the fourth embodiment are similar in structure to the previously described second embodiment. Accordingly, the parts thereof having the same functions as those in the second embodiment are given the same designations and thus the duplicate description thereof is omitted here.

Figure 17:
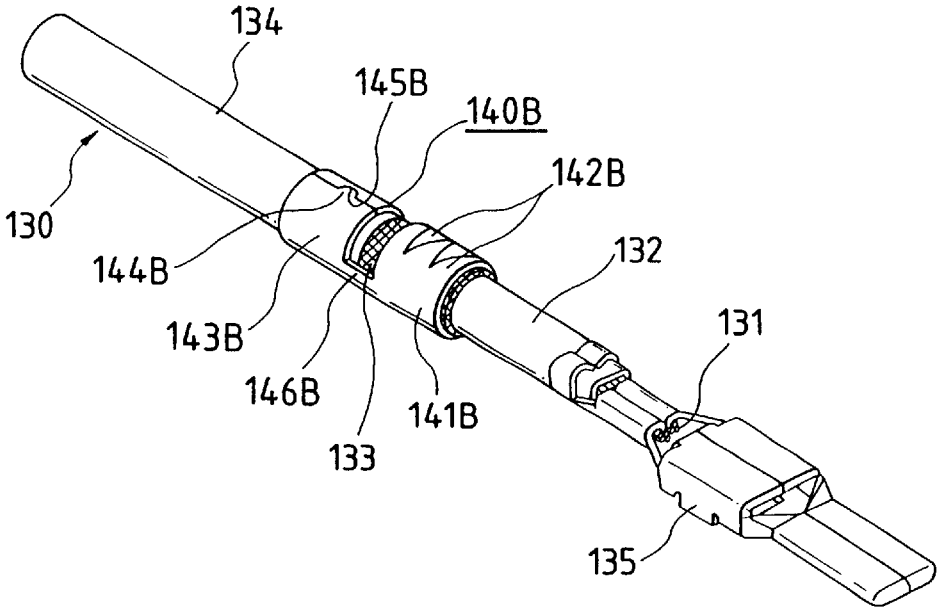
FIG. 17 is a perspective view of the shielding wire shown in FIG. 16, showing a state thereof in which the end portion treatment of the shielding wire is completed; and, FIG. 18 is a partially cutaway side view of a conventional shielding connector.
Figure 18:
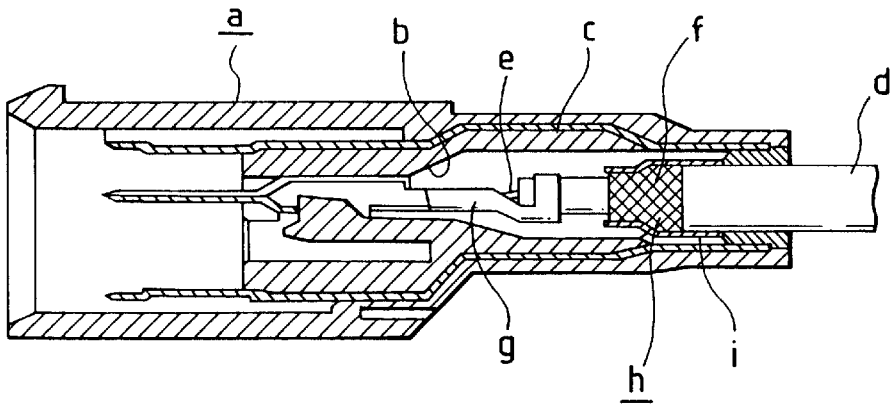
Figure 19:
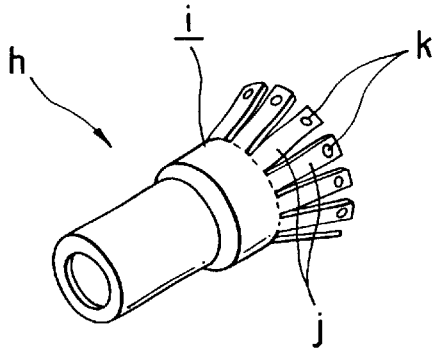
FIG. 19 is a perspective view of a shell connecting terminal.
Figure 20:
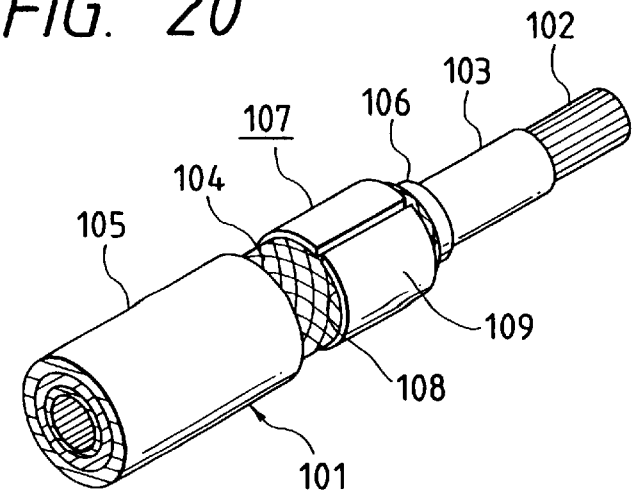
FIG. 20 is a perspective view of a conventional shielding wire.

The present connecting terminal 140B is caulked in such a manner as shown in FIG. 17 using a jig or the like; and in particular, the braided wire contact portion 141B is caulked at a position where it can be contacted with the braided wire 133 turned back toward the outer periphery side of the outer coating 134, whereas the shell contact portion 143B is caulked to the deeper side of the outer coating 134 than the turned-back braided wire 133.

That is, since the present connecting terminal 140B is structured such that there is no stepped portion between the braided wire contact portion 141B and shell contact portion 143B thereof, the manufacturing cost of the present connecting terminal 140B can be reduced.

The present invention is not limited by the embodiment which has been described hereinbefore with reference to the accompanying drawings, but, for example, the following embodiments also fall within the technical scope of the invention. Further, other various modifications and changes than the illustrated and following embodiments can also be enforced without departing from the scope of the claims set forth herein.

(1) Although, in the illustrated embodiment, description has been given of the male-side shielding connector, the present invention, of course, can also apply to a female-side shielding connector.

(2) The invention can also apply even when the elastic tongue piece is provided only on one side of the inner surfaces of the prismatic-shaped shielding shell.

(3) The invention can also apply even when the elastic tongue piece is provided on one of the mutually opposing inner surfaces of the prismatic-shaped shielding shell, whereas a contact piece, which will not be deformed elastically, is provided on the other inner surface.

(4) Although, in the above-mentioned embodiments, the receiving tube portion is formed by caulking a U-shaped metal plate, this is not limitative but, for example, the receiving tube portion may also be formed of a cylindrical-shaped resin material, or the receiving tube portion itself may be omitted.

(5) In the above-mentioned fourth embodiment, there is illustrated a case where the connecting terminal with no stepped portion existing between the braided wire contact portion and shell contact portion thereof is caulked to the outer coating remaining side of the shielding wire with the braided wire turned back to the outer periphery side of the outer coating. However, the invention is not limited to this but, for example, the braided wire of the shielding wire may not be turned back but the connecting terminal may be caulked to the outer coating removed side of the shielding wire.

What is claimed is:

1. A shielding connector comprising:

a shielding shell disposed within a housing; and a shielding wire including a core wire connected to a terminal metal member and a braided wire connected to a shell connecting terminal, said shell connecting terminal having a shell connecting portion which is electrically connected to said shielding shell;

wherein said shell connecting portion is formed in an annular shape, said shielding shell includes an elastic tongue piece which is contactable with said shell connecting portion formed on inner periphery thereof, and said elastic tongue piece comprises a contact portion that contacts the shell connecting portion, a first inclined portion inclined outwardly of a longitudinal axis of said shielding shell and extending from said contact portion in a frontward direction of the shielding connector and a second inclined portion inclined outwardly of the longitudinal axis of said shielding shell and extending from said contact portion in a rearward direction of the shielding connector.

2. The shielding connector as claimed in claim 1, wherein said terminal metal member has an insertion direction limit with respect to a terminal insertion chamber, and said shielding shell is formed in a prismatic shape.

3. The shielding connector as claimed in claim 1, wherein said shell connecting portion is formed in an annular shape with ends by caulking a U-shaped metal plate.

4. The shielding connector as claimed in claims 1, wherein, on the mutually opposing inner surfaces of said prismatic-shaped shielding shell, there are disposed a pair of said elastic tongue pieces.

5. The shielding connector as claimed in claim 1, wherein said elastic tongue piece further comprises a restrict portion that restricts movement of the elastic tongue piece in direction outward from the longitudinal axis of the shielding shell.

6. The shielding connector as claimed in claim 1, wherein said elastic tongue piece further comprises an end portion that contacts said shielding shell.

* * * * *